US005922193A

United States Patent [19]

Gupte et al.

[11] Patent Number: 5,922,193

[45] **Date of Patent: *Jul. 13, 1999**

[54] ADDITION OF ETHERS OR ALDEHYDES TO FURFURAL FOR AROMATIC EXTRACTIONS

[75] Inventors: Anagha Avinash Gupte, Moorestown; Michael E. Landis, Sewell; David Owen Marler, Deptford, all of N.J.

[73] Assignee: Mobil Oil Corporation, Fairfax, Va.

[ * ] Notice: This patent issued on a continued prosecution application filed under 37 CFR 1.53(d), and is subject to the twenty year patent term provisions of 35 U.S.C. 154(a)(2).

[21] Appl. No.: 08/704,058

[22] Filed: Aug. 28, 1996

Related U.S. Application Data

[ 60] Provisional application No. 60/003,137, Sep. 1, 1995.

[51] Int. Cl.[6] ..... C10G 21/02

[52] U.S. Cl. ..... 208/323; 208/311; 208/327; 208/333; 208/334; 208/332; 585/863; 585/865; 585/866

[58] Field of Search ..... 208/311, 327, 208/323, 334, 333, 332; 585/863, 865, 866

[56] References Cited

U.S. PATENT DOCUMENTS

| | | | |
|---|---|---|---|
| 2,079,885 | 5/1937 | Voorhees | 196/13 |
| 2,086,484 | 7/1937 | Towne | 208/334 |
| 2,138,832 | 12/1938 | Brown et al. | 208/323 |
| 2,176,746 | 10/1939 | Pokorny et al. | 208/334 |
| 2,698,276 | 12/1954 | Francis | 196/13 |
| 3,449,462 | 6/1969 | Alders et al. | 260/674 |
| 3,488,283 | 1/1970 | Button et al. | 208/316 |
| 3,539,504 | 11/1970 | Cummins | 208/327 |
| 3,567,626 | 3/1971 | Bozeman et al. | 208/316 |
| 3,567,627 | 3/1971 | McDonald et al. | 208/334 |
| 3,981,798 | 9/1976 | Ries et al. | 208/334 |
| 4,208,263 | 6/1980 | Audeh et al. | 204/188 |
| 4,260,476 | 4/1981 | Vidueira et al. | 208/333 |
| 4,273,645 | 6/1981 | Audeh et al. | 585/865 |
| 4,401,560 | 8/1983 | Vidueira et al. | 208/333 |
| 4,571,295 | 2/1986 | Forte | 208/334 |

*Primary Examiner*—Walter D. Griffin
*Attorney, Agent, or Firm*—Brian C. Jones; Malcolm D. Keen

[57] ABSTRACT

A process to improve the performance of furfural for aromatics extraction from gas oils and lube distillates by the addition of ethers and/or aldehydes, preferably having a dielectric constant less than about 40 @ 25° C.

4 Claims, No Drawings

ADDITION OF ETHERS OR ALDEHYDES TO FURFURAL FOR AROMATIC EXTRACTIONS

This is an application under 35 USC §111(a) of provisional application 60/003,137, filed on Sep. 1, 1995.

The invention relates to separation of aromatic compounds from gas oil and lube oil fractions using a furfural/co-solvent mixture.

Refining of crude oil to produce lubricating oil is one of the oldest refinery arts. Suitable crudes are fractionated to isolate a suitable boiling range material, usually in the 600° to 1100° F. (316° to 593° C.) range to produce a distilled oil fraction. Various solvent purification steps are then used to reject components not suitable for lubricating stock. Aromatics are too unstable, and refiners resort to various means to remove aromatics from potential lube fractions. Wile many solvents were proposed for aromatics extraction, furfural has been a preferred solvent since about 1933 when the first commercial furfural extraction units were built.

Furfural is denser than oil and related to formaldehyde. It is a solvent for aromatics. When furfural and a heavy oil fraction mix, the furfural dissolves much of the aromatics content of the heavy oil. Upon settling, an extract phase or dense furfural phase containing most of the aromatics separates from a raffinate phase of lighter hydrocarbons with a reduced amount of aromatics. As in most liquid/liquid extraction processes the separation is not perfect. Some aromatics remain in the raffinate and some furfural dissolves in the raffinate. Fractionation of the extract and raffinate recovers the furfural solvent for reuse.

Some representative patents on preparation of lubricants by solvent extraction include U.S. Pat. No. 2,698,276, U.S. Pat. No. 3,488,283 and U.S. Pat. No. 4,208,263 which are incorporated by reference.

Dearomatization of lube distillates by furfural extraction is discussed in U.S. Pat. No. 2,079,885. Since the furfural unit is often a bottleneck in the lube refining process, improvement in the capacity of furfural without loss of selectivity would be of value to the lube refining industry. Therefore, it is an object of the present invention to improve the furfural extraction performance.

It has now been found that the addition of ethers and/or aldehydes, preferably having a dielectric constant less than about 40 @ 25° C., improves the capacity of furfural for extraction of nitrogen, sulfur compounds and aromatics. Nitrogen and sulfur compounds are sludge precursors. The process of the present invention results in improved thermal and oxidation stability of the lube basestock.

The invention therefore includes a process for the separation of a mixture of organic compounds which comprises contacting the organic compound mixture with a mixed solvent comprising furfural and one or more ethers and/or aldehydes, preferably having a dielectric constant less than about 40 @ 25° C., to form two phases and subsequently separating the phases that formed.

The invention further includes a process for the production of lubricant oil from an aromatic containing petroleum fraction comprising contacting the petroleum fraction with a solvent comprising furfural and one or more ethers and/or aldehydes, preferably having a dielectric constant less than about 40 @ 25° C., under extraction conditions, producing an aromatics reduced raffinate product.

DETAILED DESCRIPTION OF THE PRESENT INVENTION

FEEDSTOCK

Hydrocarbons which may be separated according to the process of the present invention include hydrocarbon oil fractions obtained by direct distillation, by thermal or catalytic cracking or by hydrocracking. The extraction of low boiling aromatic containing hydrocarbon oil fractions with the solvent mixture of the present invention yields substantially pure aromatic hydrocarbons such as benzene and toluene.

This process is particularly applicable to paraffinic feedstocks boiling in the lubricant boiling range. The feedstocks may typically comprise hydrocarbons having about a 600° F.+ (316° C.) initial boiling point and a final boiling point of about 1100° F. (593° C.), particularly those having a boiling range of about 700° F. (371° C.) to 1050° F. (566° C.), most preferably those fractions boiling in the range of 750° F. (399° C.) to 1000° F. (538° C.). These distillate lubricant stocks are usually referred to as neutrals and are the distillate fractions of the vacuum tower.

SOLVENT EXTRACTION

Solvent extraction is conducted by contacting the distillate fraction with a selective solvents Since the feedstock contains aromatics usually ranging from at least about 25 wt. %, specifically from 25 to 80 wt. % and more specifically from 30 wt. % to 60 wt %, the feedstock is initially subjected to an extraction step. Extraction utilizes a solvent which is selective for aromatics, such as furfural, and removes the aromatics which contribute to poor stability and VI.

The solvent extraction is conducted with a solvent to oil ratio in the range of from about 0.5:1 to 10:1, such as in the range of from about 0.75:1 to 5:1, depending on the feedstock.

The operating conditions for furfural extraction cover a temperature range of about 75° F. (24° C.) to about 350° F. (177° C.), preferably from about 100° F. (38° C.) to 325° F. (163° C.) and more preferably from about 125° F.(52° C.) to 300° F.(149° C.). The yield in terms of volume percent typically ranges from 30 to 80. The operation may be conducted as a batch or continuous operation.

The characteristics of the product of solvent extraction are very important, and consideration of the solvent extraction conditions coupled with the choice of feed is necessary to achieve a product with the desired viscosity and VI, maximum yield of high VI product is achieved by adjusting the extraction severity.

The resulting raffinate should have a VI of at least about 85, preferably 90. The aromatics-reduced raffinate should contain at most about 40 wt. % aromatics, preferably ranging from about 10 to 30 wt. %, even more preferably from 10–20 wt. %.

The extractions may be performed by conventional means, such as in a multistage countercurrent system, in a column with packing material or provided with perforated plates or in a column with a rotating shaft provided with discs.

SOLVENT

The process of the present invention involves the addition of one or more ethers and/or aldehydes to furfural to enhance its extraction performance. In particular, aliphatic ethers, glycol ethers, aromatic ethers, cyclic ethers and diethers, and aromatic aldehydes, have a high capacity for aromatics as well as paraffins in lube distillates and are miscible with lube distillates at temperatures as low as 100° F.

The ability of solvent to solvate ions is determined by its polarity, which is usually reported as a dielectric constant. A highly polar solvent has a high dielectric constant. Ethers and aldehydes for use as co-solvents in the process of the present invention preferably have a dielectric constant @ 25° C. of less than about 40, preferably less than about 30, more preferably less than about 20 and even more preferably less than about 10.

The process of the present invention involves the addition of small volumes of one or more co-solvents to furfural to enhance the extraction performance. Suitable co-solvents include aliphatic ethers such as dibutyl ether and tertiary amyl methyl ether (TAME); glycol ethers such as monoglyme, ethylene glycol diethylether (ethyl glyme) and diethylene glycol monoethyl ether; aromatic ethers such as methoxybenzene (anisole) and ethoxybenzene (phenetole); cyclic ethers and diethers such as tetrahydrofuran (THF), 1,4 dioxane and 1,3 dioxolane; aromatic aldehydes such as benzaldehyde and salicylaldehyde; and mixtures thereof. Table I below lists some suitable co-solvents and their dielectric constants.

TABLE 1

| | Dielectric Constant @ 25° C. | Density @ 20° C. g/cc | Boiling Point °F./C. |
|---|---|---|---|
| Dibutyl Ether | 3.06 | 0.764 | 288/142 |
| TAME | | 0.77 | 185/85 |
| Monoglyme | 7.2 | 0.868 | 185/85 |
| Ethyl Glyme | | 0.842 | 250/121 |
| Diethylene Glycol Monoethyl Ether | 29.6 | 0.999 | 395/202 |
| Anisole | 4.33 | 0.996 | 311/155 |
| THF | 7.39 | 0.888 | 150/66 |
| 1,4 Dioxane | 2.21 | 1.034 | 212/100 |
| 1,3 Dioxolane | 7.34 | 1.060 | 167/75 |
| Benzaldehyde | 19 | 1.044 | 352/178 |
| Salicylaldehyde | 17 | 1.146 | 386/197 |

Generally, the co-solvent is added in an amount less than about 35 vol. % based on total solvent such as less than about 25 vol. % based on total solvent, less than about 15 vol. % based on total solvent and less than about 10 vol. % based on total solvent, depending on the feedstock. For example, a 5 vol. % co-solvent/95 vol % furfural blend may be used in the extraction process of the present invention when the feedstock is Arab Light heavy neutral distillate.

Co-solvents for use in the process of the present invention also have a boiling point in the range of from about 50° to 225° C., preferably in the range of from about 75° to 200° C. and more preferably in the range of from about 100° to 175° C.

The addition of co-solvents, such as THF, to furfural improves its capacity for extraction of aromatics from lube distillates without loss in selectivity.

Use of co-solvents in furfural extraction may increase the raffinate yield at the same raffinate refractive index (RI). The process of the present invention also allows for retrofitting existing equipment.

The addition of the co-solvents of the present invention also reduces the temperature of miscibility of the resultant furfural/co-solvent blend with the organic compound mixture compared to furfural alone. The temperature of miscibility of the solvent and the oil is defined as the temperature at which the solvent and the distillate are miscible in all proportions.

An additional advantage of the furfural/co-solvent mixtures of the present invention is that to reach the same extraction result as when using furfural alone the necessary quantity of furfural/co-solvent may be smaller.

At the same selectivity as furfural, the furfural/co-solvent mixtures of the present invention generally have a better solvency than furfural alone. For example, when high boiling hydrocarbon oil distillates or residual hydrocarbon oil fractions are to be extracted, the solvency of furfural fails and relatively high solvent ratios have to be applied.

Another advantage of the present invention is the somewhat higher solvency of the furfural/co-solvent mixtures renders it possible to perform extraction at lower temperatures than with furfural alone. Operation at lower temperature prevents undesirable conversions of thermally unstable compounds present in the mixture and enables the separation of any such products formed more efficiently.

The following examples illustrate the process of the present invention.

Arab Light heavy neutral distillate having the properties as set forth below in Table 2, was used for each extraction example.

TABLE 2

| Properties of Arab Light Heavy Neutral Distillate | |
|---|---|
| Refractive Index | 1.5062 |
| API Gravity | 18.8 |
| Kinematic Viscosity @ 100° C. | 18.07 cS |
| Kinematic Viscosity @ 300° F. | 6.036 cS |
| Total Sulfur | 2.9 wt. % |
| Aliphatic Sulfur | 0.40 wt. % |
| Total Nitrogen | 1200 ppm |
| Basic Nitrogen | 311 ppm |
| Paraffins | 12.2 wt. % |
| Mono Napthenes | 5.5 wt. % |
| Poly Naphthenes | 17.1 wt. % |
| Aromatics | 65.2 wt. % |

For each furfural/co-solvent bland to be tested single stage batch extraction was performed in a one liter jacketed glass extraction apparatus. Approximately 200 cc. of the Arab Light heavy neutral distillate were heated and loaded into the extraction apparatus Solvent was added to the vessel to give the desired solvent treat (total solvent:oil volume ratios of 1:1, 2:1 and 3:1. These ratios are typically referred to as 100%, 200% and 300% solvent dosage). The extractions were performed at temperatures ranging from 200°–230° F. (93°–110° C.). Once the mixture of solvent and oil reached the extraction temperature, the mixture was agitated for 5 minutes at 1000 rpm. After agitation, the mixture was allowed to settle for 15 minutes at the extraction temperature and separted into a raffinate and extract phase.

The two phases were weighed to ensure material balance closure. The solvent was stripped from the extract and raffinate with nitrogen under vacuum. The stripped raffinate and extract phases were weighed and the raffinate yield was obtained. Final raffinate samples were analyzed for API gravity and Refractive index (RI). API gravity was measured on the final extracts.

In Examples 1–3, furfural was used alone. The furfural/co-solvent blends tested were furfural/dibutyl ether (Examples 4–6), furfural/TAME (Examples 7–12), furfural/monoglyme (Examples 13–18), furfural/ethyl glyme (Examples 19–21) furfural/diethylene glycol monoethyl ether (Examples 22–25), furfural/THF (Examples 26–34), furfural/anisole (Examples 35–38), furfural/1,4 dioxane (Examples 39–41), furfural/1,3 dioxolane (Examples 42–44), furfural/benzaldehyde (Examples 45–46) and furfural/salicylaldehyde (Examples 47–48). Vol. % furfural/vol. % co-solvent, extraction temperature and solvent dosage for each example are set forth in Table 3.

TABLE 3

| Example | | Extraction Temp. °F.(C.) | Solvent Dosage |
|---|---|---|---|
| 1 | Furfural | 230(110) | 100% |
| 2 | Furfural | 230(110) | 200% |
| 3 | Furfural | 230(110) | 300% |
| 4 | 90 Vol % Furf/10 Vol % Dibutyl Ether | 210(99) | 100% |
| 5 | 90 Vol % Furf/10 Vol % Dibutyl Ether | 210(99) | 200% |
| 6 | 90 Vol % Furf/10 Vol % Dibutyl Ether | 210(99) | 300% |
| 7 | 95 vol % Furf/5 vol % TAME | 220(104) | 100% |
| 8 | 95 vol % Furf/5 vol % TAME | 220(104) | 200% |
| 9 | 95 vol % Furf/5 vol % TAME | 220(104) | 300% |
| 10 | 95 vol % Furf/5 vol % TAME | 210(99) | 100% |
| 11 | 95 vol % Furf/5 vol % TAME | 210(99) | 200% |
| 12 | 95 vol % Furf/5 vol % TAME | 210(99) | 300% |
| 13 | 95 vol % Furf/5 vol % Monoglyme | 220(104) | 100% |
| 14 | 95 vol % Furf/5 vol % Monoglyme | 220(104) | 200% |
| 15 | 95 vol % Furf/5 vol % Monoglyme | 220(104) | 300% |
| 16 | 95 vol % Furf/5 vol % Monoglyme | 210(99) | 100% |
| 17 | 95 vol % Furf/5 vol % Monoglyme | 210(99) | 200% |
| 18 | 95 vol % Furf/5 vol % Monoglyme | 210(99) | 300% |
| 19 | 95 vol % Furf/5 vol % Ethyl Glyme | 210(99) | 100% |
| 20 | 95 vol % Furf/5 vol % Ethyl Glyme | 210(99) | 200% |
| 21 | 95.vol % Furf/5. vol % Ethyl Glyme | 210(99) | 300% |
| 22 | 90 vol % Furf/10 vol % Diethylene Glycol Monoethyl Ether | 231(111) | 100% |
| 23 | 90 vol % Furf/10 vol % Diethylene Glycol Monoethyl Ether | 231(111) | 200% |
| 24 | 80 vol % Furf/20 vol % Diethylene Glycol Monoethyl Ether | 215(101) | 100% |
| 25 | 80 vol % Furf/20 vol % Diethylene Glycol Monoethyl Ether | 215(101) | 200% |
| | 95 vol % Furf/5 vol % THF | 220(104) | 100% |
| 27 | 95 vol % Furf/5 vol % THF | 220(104) | 200% |
| 28 | 95 vol % Furf/5 vol % THF | 220(104) | 300% |
| 29 | 95 vol % Furf/5 vol % THF | 210(99) | 100% |
| 30 | 95 vol % Furf/5 vol % THF | 210(99) | 200% |

TABLE 3-continued

| Example | | Extraction Temp. °F.(C.) | Solvent Dosage |
|---|---|---|---|
| 31 | 95 vol % Furf/5 vol % THF | 210(99) | 300% |
| 32 | 95 vol % Furf/5 vol % THF | 200(93) | 100% |
| 33 | 95 vol % Furf/5 vol % THF | 200(93) | 200% |
| 34 | 95 vol % Furf/5 vol % THF | 200(93) | 300% |
| 35 | 95 vol % Furf/5 vol % Anisole | 220(104) | 100% |
| 36 | 95 vol % Furf/5 vol % Anisole | 220(104) | 200% |
| 37 | 95 vol % Furf/5 vol % Anisole | 210(99) | 200% |
| 38 | 95 vol % Furf/5 vol % Anisole | 210(99) | 300% |
| 39 | 95 vol % Furf/5 vol % 1,4 Dioxane | 210(99) | 100% |
| 40 | 95 vol % Furf/5 vol % 1,4 Dioxane | 210(99) | 200% |
| 41 | 95 vol % Furf/5 vol % 1,4 Dioxane | 210(99) | 300% |
| 42 | 90 vol % Furf/10 vol %.1,3 Dioxane | 210(99) | 100% |
| 43 | 90 vol % Furf/10 vol % 1,3 Dioxane | 210(99) | 200% |
| 44 | 90 vol % Furf/10 vol % 1,3 Dioxane | 21(99) | 300% |
| 45 | 90 vol % Furf/10 vol % Benzaldehyde | 201(94) | 100% |
| 46 | 90 vol % Furf/10 vol % Benzaldehyde | 201(94) | 200% |
| 47 | 90 vol % Furf/10 vol % Salicylaldehyde | 205(96) | 100% |
| 48 | 90 vol % Furf/10 vol % Salicylaldehyde | 205(96) | 200% |

The results from the batch extraction examples are shown below in Table 4. Commercially, lube extraction units are operated to a RI specification since for a particular lube crude and type of refining process, raffinate RI correlates with the viscosity index (VI) of the dewaxed oil (DWO), with lower RI corresponding to higher VI. Analysis of the data in Table 4 shows that for extraction the furfural/co-solvent blends are more effective than furfural alone, resulting in a 2–3 volume % improvement in raffinate ield at constant raffinate RI.

TABLE 4

| Example | Solvent | Raffinate Yield, Vol % | Raffinate RI | Raffinate API Gravity | Extract API Gravity |
|---|---|---|---|---|---|
| 1 | Furfural | 76.18 | 1.4943 | 21.67 | 10.57 |
| 2 | Furfural | 62.22 | 1.4854 | 24.04 | 11.07 |
| 3 | Furfural | 53.88 | 1.4799 | 25.36 | 11.94 |
| 4 | 90 Vol % Furf/10 Vol % Dibutyl Ether | 79.69 | 1.4945 | 21.39 | 8.57 |
| 5 | 90 Vol % Furf/10 Vol % Dibutyl Ether | 64.42 | 1.4863 | 23.46 | 10.53 |
| 6 | 90 Vol % Furf/10 Vol % Dibutyl Ether | 54.67 | 1.4813 | 24.81 | 11.75 |
| 7 | 95 vol % Furf/5 vol % TAME | 76.62 | 1.4943 | 21.92 | 9.68 |
| 8 | 95 vol % Furf/5 vol % TAME | 62.93 | 1.4852 | 24 | 10.9 |
| 9 | 95 vol % Furf/5 vol % TAME | 56.37 | 1.4799 | 25.01 | 11.62 |
| 10 | 95 vol % Furf/5 vol % TAME | 80.97 | 1.4938 | 21.65 | 8.1 |
| 11 | 95 vol % Furf/5 vol % TAME | 67.16 | 1.4855 | 23.74 | 9.81 |
| 12 | 95 vol % Furf/5 vol % TAME | 58.96 | 1.4808 | 24.97 | 10.9 |
| 13 | 95 vol % Furf/5 vol % Monoglyme | 77.89 | 1.4938 | 21.73 | 9.6 |
| 14 | 95 vol % Furf/5 vol % Monoglyme | 63.71 | 1.4843 | 23.94 | 10.73 |
| 15 | 95 vol % Furf/5 vol % Monoglyme | 56.62 | 1.4805 | 25.12 | 11.43 |
| 16 | 95 vol % Furf/5 vol % Monoglyme | 79.94 | 1.4932 | 21.75 | 8.4 |
| 17 | 95 vol % Furf/5 vol % Monoglyme | 67.15 | 1.4851 | 23.86 | 9.61 |
| 18 | 95 vol % Furf/5 vol % Monoglyme | 59.31 | 1.4808 | 25.06 | 10.88 |
| 19 | 95 vol % Furf/5 vol % Ethyl Glyme | 76.6 | 1.4932 | 21.75 | 8.4 |
| 20 | 95 vol % Furf/5 vol % Ethyl Glyme | 63.9 | 1.4851 | 23.86 | 9.61 |
| 21 | 95 vol % Furf/5 vol % Ethyl Glyme | 57.7 | 1.4808 | 25.06 | 10.68 |
| 22 | 90 vol % Furf/10 vol % Diethylene Glycol Monoethyl Ether | 72.8 | 1.4927 | 21.7 | 10.2 |
| 23 | 90 vol % Furf/10 vol % Diethylene Glycol Monoethyl Ether | 66.6 | 1.4833 | 23.91 | 8.5 |
| 24 | 80 vol % Furf/20 vol % Diethylene Glycol Monoethyl Ether | 76.5 | 1.4940 | 21.6 | 8.9 |
| 25 | 80 vol % Furf/20 vol % Diethylene Glycol Monoethyl Ether | 61.8 | 1.4858 | 23.9 | 10.3 |
| 26 | 95 vol % Furf/5 vol % THF | 75.27 | 1.4944 | 21.56 | 9.43 |
| 27 | 95 vol % Furf/5 vol % THF | 61.35 | 1.485 | 23.98 | 11.42 |
| 28 | 95 vol % Furf/5 vol % THF | 52.71 | 1.4802 | 25.3 | 12.3 |

TABLE 4-continued

| Example | Solvent | Raffinate Yield, Vol % | Raffinate RI | Raffinate API Gravity | Extract API Gravity |
|---|---|---|---|---|---|
| 29 | 95 vol % Furf/5 vol % THF | 78.94 | 1.4935 | 21.76 | 8.95 |
| 30 | 95 vol % Furf/5 vol % THF | 66.37 | 1.4856 | 23.86 | 9.91 |
| 31 | 95 vol % Furf/5 vol % THF | 57.73 | 1.4806 | 25.14 | 11.08 |
| 32 | 95 vol % Furf/5 vol % THF | 81.5 | 1.4923 | 21.74 | 7.42 |
| 33 | 95 vol % Furf/5 vol % THF | 69.71 | 1.486 | 23.72 | 8.79 |
| 34 | 95 vol % Furf/5 vol % THF | 59.8 | 1.4812 | 25.07 | 10.51 |
| 35 | 95 vol % Furf/5 vol % Anisole | 75.97 | 1.4944 | 21.59 | 10.88 |
| 36 | 95 vol % Furf/5 vol % Anisole | 61.62 | 1.4847 | 23.97 | 11.35 |
| 37 | 95 vol % Furf/5 vol % Anisole | 65.92 | 1.4858 | 23.89 | 10.03 |
| 38 | 95 vol % Furf/5 vol % Anisole | 58.24 | 1.4809 | 25.1 | 10.97 |
| 39 | 95 vol % Furf/5 vol % 1,4 Dioxane | 81.44 | 1.4927 | 21.33 | 7.72 |
| 40 | 95 vol % Furf/5 vol % 1,4 Dioxane | 67.93 | 1.485 | 23.47 | 9.24 |
| 41 | 95 vol % Furf/5 vol % 1,4 Dioxane | 59.03 | 1.4799 | 24.77 | 10.53 |
| 42 | 90 vol % Furf/10 vol % 1,3 Dioxane | 77.93 | 1.4928 | 21.65 | 8.72 |
| 45 | 90 vol % Furf/10 vol % Benzaldehyde | 74 | 1.4917 | 22.34 | 8.21 |
| 46 | 90 vol % Furf/10 vol % Benzaldehyde | 62.5 | 1.4840 | 24.15 | 9.71 |
| 47 | 90 vol % Furf/10 vol % Salicylaldehyde | 75.3 | 1.4922 | 21.97 | 8.48 |
| 48 | 90 vol % Furf/10 vol % Salicylaldehyde | 61.4 | 1.4844 | 24.16 | 10.08 |

In summation, the present invention provides a process for the separation of a mixture of organic compounds which comprises contacting the organic compound mixture with a mixed solvent comprising furfural and one or more co-solvents, preferably having a dielectric constant less than about 40 @ 25° C., to form two phases and subsequently separating the phases that formed.

The present invention further provides a process for the production of lubricant oil from an aromatic containing petroleum fraction comprising contacting the petroleum fraction with a solvent comprising furfural and one or more ethers and/or aldehydes, preferably having a dielectric constant less than about 40 @ 25° C., under extraction conditions, producing an aromatics reduced raffinate product. The co-solvent may have a dielectric constant less than about 30 @ 25° C. The co-solvent may have a dielectric constant less than about 20 169 25° C. The co-solvent may have a dielectric constant less than about 10 @ 25° C. The co-solvent may be in an amount in the range of less than 35 vol. % total solvent.

The process of the present invention may have a temperature in the range of from about 75° to about 350° F.

We claim:

1. A method for improving the performance of a furfural extraction unit, comprising: mixing furfural extraction solvent in said unit with one or more ethers of aldehydes selected according to their dielectric constants and reducing the operating temperature of said unit as compared to the operating temperature for furfural extraction solvent alone, while maintaining product quality as measured by raffinate refractive index and increasing raffinate yield.

2. The method according to claim 1, where the ether or aldehyde has a dielectric constant of less than about 40 at a temperature of 25° C.

3. The method according to claim 1, where the ether is selected from the group consisting of aliphatic ethers, glycol ethers, aromatic ethers and cyclic ethers, and the aldehyde is an aromatic aldehyde.

4. The method according to claim 1, where the ether is selected is from the group consisting of dibutyl ether, tertiary amyl methyl ether, monoglyme ethyl glyme, diethylene glycol monoethyl ether, anisole, phenetole, tetrahydrofuran, dioxane, dioxalane; and the aldehyde is selected from the group consisting of benzaldehyde and salicylaldehyde.

* * * * *